US008607946B2

(12) United States Patent
Tamarkin

(10) Patent No.: US 8,607,946 B2
(45) Date of Patent: Dec. 17, 2013

(54) CONVERTIBLE LUGGAGE BAG

(76) Inventor: Lauri Tamarkin, Gilbert, AZ (US)

( * ) Notice: Subject to any disclaimer, the term of this patent is extended or adjusted under 35 U.S.C. 154(b) by 248 days.

(21) Appl. No.: 12/950,788

(22) Filed: Nov. 19, 2010

(65) Prior Publication Data

US 2012/0125728 A1 May 24, 2012

(51) Int. Cl.
*A47B 61/06* (2006.01)
*A45C 13/04* (2006.01)

(52) U.S. Cl.
USPC ..... 190/13 R; 190/18 R; 190/39; 190/115; 206/287.1

(58) Field of Classification Search
USPC ..... 190/13 R, 15.1, 18 A, 39, 1.18 R, 115; 206/287, 287.2, 289, 287.1; 312/6, 312/240, 294; 211/85.3, 124, 187; 280/655.1
See application file for complete search history.

(56) References Cited

U.S. PATENT DOCUMENTS 1,438,737 A * 12/1922 Witbeck ..... 206/282
1,706,887 A * 3/1929 Knostman ..... 211/85.3
1,717,078 A * 6/1929 Wheary ..... 211/85.3
1,913,021 A * 6/1933 Butterick ..... 206/292
1,984,446 A * 12/1934 Wheary ..... 206/289
2,639,793 A * 5/1953 Hellman ..... 190/13 R
2,681,128 A * 6/1954 Staffa ..... 190/13 R
3,552,529 A * 1/1971 Marshall ..... 190/13 R
4,538,709 A * 9/1985 Williams et al. ..... 190/18 A
6,065,574 A * 5/2000 Miyoshi ..... 190/18 A
2002/0023812 A1* 2/2002 Bernbaum et al. ..... 190/111
2002/0139627 A1* 10/2002 Mahanavanont ..... 190/115
2005/0133326 A1* 6/2005 Hoberman et al. ..... 190/18 R
2006/0060440 A1 3/2006 Myers
2008/0283350 A1 11/2008 Vorderkunz
2009/0266833 A1 10/2009 Savage et al.

* cited by examiner

*Primary Examiner* — Sue A Weaver
(74) *Attorney, Agent, or Firm* — Holland & Hart LLP; Bryan G. Pratt

(57) ABSTRACT

An exemplary system configured convert from a luggage back to a standing clothing rack and back. First, the lids rotate 180 degrees along the top edge of the base from a closed position to extend the height of the rack. While configured as a rack, the system is supported on each side by a support structure which also extends from the base. The luggage bag may be double sided, such that both sides mirror each other, and fasten to the handle, base, or upright lids. One or more hanger bars may either swing out from, or be fastened to, the upright lids, to support hanging garments. The hanger bars may also be configured to keep hanging garments evenly spaced by equally spaced grooves along the top edge of the hanger bar. The system may later be converted back into a luggage bag.

20 Claims, 13 Drawing Sheets

CONVERTIBLE LUGGAGE BAG

BACKGROUND

Several professions, including dancers, cheerleaders, actors, business men, athletes, models, and pageant participants frequently travel and are given limited time and space to dress. Many of these professionals and performers have numerous sets of clothing to wear, depending on the performance or situation.

Traditionally, these numerous changes of clothes have been stored in a garment bag, a steam trunk, or a suitcase. When accessed, the container that the clothes are stored in provide little or no protection from wrinkling, ripping, or soiling the clothes.

More specifically, circumstances are often such that one or more changes of clothing are required in a location that there simply is no rack, hook, shelf, or other location in which to place garments that must stay wrinkle free and orderly. In such a situation, clothing is often dropped, wrinkled, stained or otherwise ruined for its intended purpose. Furthermore the lack of order created by searching for a particular garment or accessory can create disorder, cause frustration, and slow down a user that is typically short on time.

SUMMARY

According to the present exemplary system and method, a convertible luggage bag is provided that includes a frame or other support structure and a stabilization system that converts a luggage bag into an independently standing garment rack. Furthermore, according to one exemplary embodiment, the system is specifically designed to be used as a fully functional luggage bag until arrival at the desired destination, where the system may be converted into a standing rack configured to orderly and protectively store individual garments.

According to another exemplary embodiment, a luggage bag includes a lid that opens about the top side of the base, to give the garment rack sufficient height to support long garments. According to this exemplary embodiment, the one or more lids is fastened in an upright position and includes hanger bars that may extend tangentially from the top of the upright lid(s). The exemplary system may also include a retractable support structure on each side of the base of the luggage bag to provide stability and increased footprint to the bag in response to an elevated weight distribution when clothing or other articles are hung on an elevated portion of the system. Finally, the system may be converted back into a fully functioning luggage bag by retracting the support structures and bars, unfastening the lid(s) from the upright position, and placing clothes or other portable items inside.

Yet another exemplary embodiment may also include a vertical telescoping handle which extends from the top of the base and frame of the luggage bag. According to this exemplary embodiment, one or more hanger bars for the support of clothing and other items are attached to the extended telescoping handle to provide support for hanging garments. For each side of the resulting structure that includes a extended hanger bar, one or more corresponding support structures may extend from the base, substantially parallel to the associated hanger bar, to provide added support to the structure.

BRIEF DESCRIPTION OF THE DRAWINGS

The accompanying drawings illustrate various embodiments of the principles described herein and are a part of the specification. The illustrated embodiments are merely examples and do not limit the scope of the disclosure. Throughout the drawings, identical reference numbers designate similar but not necessarily identical elements.

DETAILED DESCRIPTION

Figure 1:
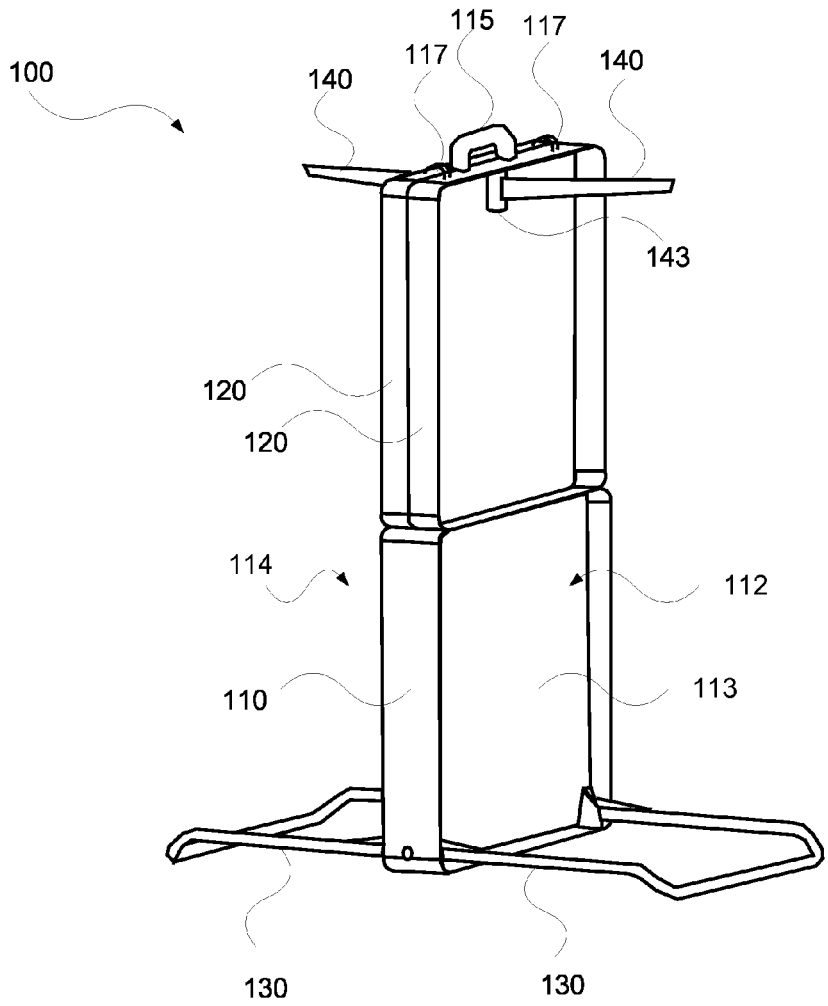
FIG. 1 is a perspective view of a exemplary convertible luggage bag system, according to principles described herein.

The current exemplary system and method addresses the need for a convenient yet portable dressing location by providing a convertible luggage bag that selectively transforms into a standing clothes rack. According to one exemplary embodiment, the present exemplary system and method is self-contained and assumes very little, if any, extra storage space or equipment beyond that of a traditional luggage system.

The present specification details both systems and methods for the use and construction of a luggage bag that is independently convertible into a standing clothing rack. While any number of luggage configurations may incorporate the use of a central structure to support a transformation of the luggage bag into a clothing rack, according to one exemplary embodiment, and for ease of explanation only, the present exemplary system (100) will be described in the context of a standard luggage bag. As noted in FIG. 1, the present exemplary system (100) includes, but is in no way limited to, a luggage base (110), at least one handle (115), one or more lids (120), a plurality of floor supports (130), at least one hanger bar (140), a barrier (113) within the luggage base (110), and any other features, devices, structures, or mechanisms suitable to configure or convert the system (100) from a luggage bag to a standing rack, and vice versa. Additionally, according to one exemplary embodiment, the present exemplary system (100) can also be equipped with standard luggage attachments and accessories including, but in no way limited to, pivoting wheels, extra handles, labels, pockets, locks, etc.

Furthermore, according to one exemplary embodiment described in further detail below, the present luggage bag system (100) is also convertible into an upright clothing rack. According to one exemplary embodiment, the handle (115) is a telescopic pole that may extend beyond the height of the lids (120) when pivoted to their upright configuration to provide support to the resulting structure. As illustrated in FIG. 1, the lids (120), which are coupled to the top side of the luggage base (110) (the same side that the telescopic handle (115) extends from) are configured to pivot about their connection with the luggage base (110) upward and are fastened together, such as by mating members (117) to maintain a vertical position. FIG. 1 also illustrates a number of collapsible hanger bars (140) of other protrusions, that may be selectively fastened to, foldably hinged, or otherwise coupled to the top of the lids (120) and/or hinged such that the hanger bars (140) may swing out from the lid, locking into a protruding, i.e., perpendicular position from the lids (120). Furthermore, according to the present exemplary embodiment, the hanger bars (140) may also be telescoping, collapsible, and/or include grooves (310) uniformly spaced on the bar in order to keep items on hangars from becoming bunched or wrinkled.

The exemplary converted bag (100), illustrated in FIG. 1, when converted to a standing rack, may also include floor supports (130), which extend from the luggage base (110) to stabilize the resulting standing rack. As illustrated, the floor supports (130) stabilize the system (100) and prevent the standing rack from sliding or tipping over when utilized to hang clothes or other items on the collapsible hangar bars. As illustrated, the floor supports (130) may each include a singular tubing having a plurality of bends to form a floor engagement section (131). The singular tubing may be pivotably coupled to the luggage base (110) such that when in use to transport object, the floor supports (130) may be pivoted and positioned inside the luggage base (110) adjacent to or concealed within the barrier (113). Then, upon opening the lids (120), the floor supports (130) may be pivoted outward to the illustrated position perpendicular to the luggage base (110). This allows the floor engagement section (131) to contact the floor and broaden the effective stabilizing base of the converted bag (100).

Thus, when the system is converted into a standing clothing rack it may be suitable to hang long garments, e.g., dresses, coats, etc. These and other uses and benefits of the systems and methods described herein will become apparent upon consideration of the following examples.

II. Exemplary System View

FIG. 1 illustrates a converted luggage bag system, according to one exemplary embodiment. As illustrated in the exemplary embodiment, the system (100) is configured to be a standing clothing rack, which may also be converted to a luggage bag. Upon reaching a destination, a traveler may remove the contents of the system (100), configured as a luggage bag, and convert it to an upright clothing rack for dressing and/or clothing maintenance. This system (100) allows travelers to quickly access clothing that is wrinkle free and orderly within a limited space in a quick and efficient manner.

According to this exemplary embodiment the telescopic handle (115) is extended beyond the height of the luggage base (110) and upright lids (120). The lids (120) may unzip or otherwise be uncoupled from the luggage base (110) and rotate 180 degrees about the top edge of the luggage base (110) to an upright position and fastened to the luggage base (110), handle (115), or to each other (120) by mating members (117) in order to maintain a stable configuration. As illustrated, one or more hanger bars (140) or other protrusions are attached to the lids (120), and may be positioned parallel with the floor supports (130), and perpendicular to the coplanar luggage base (110) and lids (120). These hanger bars (140) may be attached to the upright lids (120) or alternatively to a center portion of the internal support structure, such as the handle (115). According to one exemplary embodiment, the hanger bars (140) may be attached via a hinge, such that each of the hanger bars (140) are collapsible. The traveler may then either hang garments or other items from the converted luggage bag system (100).

In the exemplary embodiment illustrated in FIG. 1, the system (100) includes two lids (120) which are attached via a hinge on the short upper side of the luggage base (110). However, any number of lids (120) that are hinged and coupled to the base (110) may be used to practice the present exemplary system method. As used herein, the term "hinged" may include any rotatable connection including, but in no way limited to, an actual mechanical hinge, a living hinge created by a thin material, or any other flexible connection. The collapsible floor supports illustrated in FIG. 1 (130) may extend perpendicular to the upright luggage base (110) and coplanar lids (120) in order to provide stability to the system (100). The floor supports (130) may have a layer or feature with a high coefficient of friction to provide a more stable system (100) that is engaged with the floor.

While an exemplary system (100) is shown in FIG. 1, the exemplary components illustrated are not intended to be limiting. Indeed, other alternative hardware environments and implementations may be used. Each of the components of the system (100) will now be described in additional detail.

A. Luggage Base (110)

Figure 2:
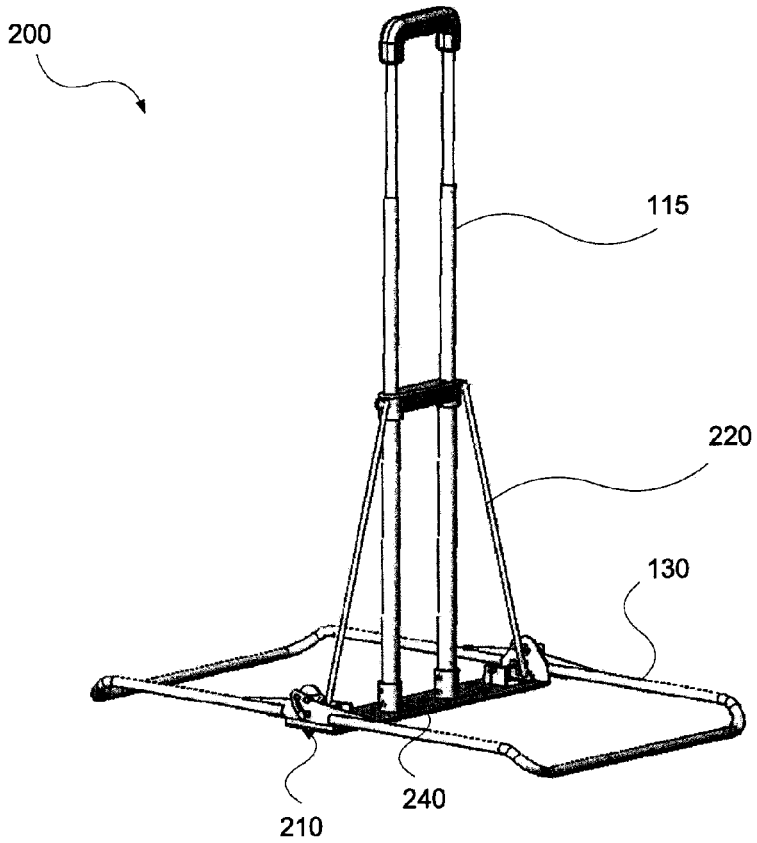
FIG. 2 is a perspective view illustrating the structural frame of an exemplary convertible luggage bag system, according to principles described herein.

The base (110) is the primary storage unit that houses the frame (200), forming the central structure that supports and joins all the other components of the system (100). The luggage base (110) functions like a base in a conventional luggage bag, however it may be fastened to and house other components including, but not limited to, the frame (200), lids (120), floor supports (130), braces (320), zippers (620), accessories (610), or any other structure which may assist the base in storing its contents, transforming the system (100) into a upright clothing rack, or supporting the weight of hanging items. According to one exemplary embodiment, one or more false floors or other barriers (113) is formed at or near the mid-plane of the luggage base. According to this exemplary embodiment, the false floors or barriers (113) form a compartment within the luggage base (110) to conceal and house the frame (200; FIG. 2) while protecting any clothes or other items stored within the base.

B. Handle (115)

The handle (115) illustrated in FIG. 1 may be a telescopic pole extending from the frame (200; FIG. 2), which may be used to tow the system (100) when it functions as a luggage bag, and as a support for the lids (120) when the system is functioning as a rack. As illustrated, the handle (115) is configured to telescope above the base (110) a distance equal to or greater than the height of the top hinged lids (120). This allows the handle (115) to at least partially support the top hinged lids (120) in their vertical configuration.

C. Lids (120)

The lids (120) function as covers, similar to traditional suitcase lids, holding the contents of the luggage bag inside the luggage base (110). When the lids (120) are closed, the lids (120) and the luggage base (110) are fastened together around the entire perimeter. The fastener (620) may include, but is in no way limited to, zippers, snaps, latches, or any other feature or mechanism which may assist in keeping the contents of the luggage bag (100) inside the luggage base (110). The lids (120) also include at least one pivoting collapsing hanger bars (140) coupled thereto.

According to one exemplary embodiment, the lids are attached to the top of the luggage base (110), or the same side that the telescoping handle (115) extends from. The lids may be attached to the luggage base (110) by any hinging mechanism including, but in no way limited to, butt hinges, butterfly hinges, flush hinges, barrel hinges, concealed hinges, continuous hinges, compliant hinges, living hinges, or any other mechanism which may allow the lids (120) to pivot approximately 180 degrees about the top edge of the base.

In the exemplary view illustrated in FIG. 1, the lids (120) are upright and fastened to the extended handle (115) such that each lid is supported by the frame (200; FIG. 2). The lids (120) may be fastened to the handle (115) with one or more devices including, but in no way limited to, buckles, latches, straps, or any other features or mechanisms that are suitable to fasten the lids (120) to the handle (115). Alternatively the lids may simply fastened together with one or more devices including, but in no way limited to, buckles, latches, straps, or any other features or mechanisms which may fasten the two or more upright lids (120) together.

In this exemplary embodiment, some of the accessories (610) are attached to the lids (120) instead of the frame (200) or the luggage base (110), e.g., the wheels. This configuration further stabilizes the system (100) while used as a rack, because the frame (200) and/or the luggage base (110) maximizes the number of contact points engaged with the ground.

D. Floor Supports (130)

As illustrated in FIG. 1, a plurality of floor supports (130) extend from the base (110) to stabilize the system (100) when configured as a standing rack. Because the luggage base (110) is relatively narrow, the weight of the hanging items that are likely to be placed on the hanger bars will cause the system to be imbalanced (or in other words, the hanging items will place the center of mass outside the volume of the base), floor supports (130) are used to stabilize the system (100). In order to provide sufficient stability, the length of the floor supports (130) should extend horizontally further than the center of mass can be placed. Thus, if the floor supports (130) extend as far along the projected ground plane as the hanger bars (140), then the center of mass will be within the volume of the frame (200), which includes the luggage base (110) and floor supports (130).

In the exemplary view of FIG. 1, both floor supports (120) and hanger bars (140) run perpendicular to the coplanar luggage base (110) and lids (120). Thus, floor supports (130) run parallel to the hanger bars (140). Similarly, in alternative exemplary embodiments, each side of a base/lid plane (110) that includes an hanger bar (140), will also use floor supports (130) that extend at least as far in the projected ground plane as the respective hanger bar (140). In the exemplary embodiment illustrated in FIG. 4, the floor supports (130) are less than the height of the luggage base (110). This design enables the floor supports (130) to rotate about the floor support joints (210) to rest flush against the luggage base (110), maximizing the amount of luggage space.

In the exemplary view of FIG. 1, a floor support (130) straddles the width of the luggage base (110), positioning each side of the floor support (130) as close to the vertical walls of the luggage base (110) as possible. While the system (100) may not require the floor supports (130) to straddle the system (100) so widely, the principle of the center of mass encourages this design. Specifically, by placing a hanger bar (140) or a portion thereof beyond the width between the luggage base (110) or the floor extensions (130), it is more likely that the system (100) becomes unbalanced. Therefore, to reduce the possibility of placing the center of mass in such a way to cause the system to become unbalanced, the floor supports (130) are placed as close to the vertical walls of the luggage base (110) as possible.

The floor supports (130) are attached to a number of components associated with the system (100), including, but in no way limited to, the frame (110), and in other exemplary embodiments feet (330), and the braces (320).

Figure 5:
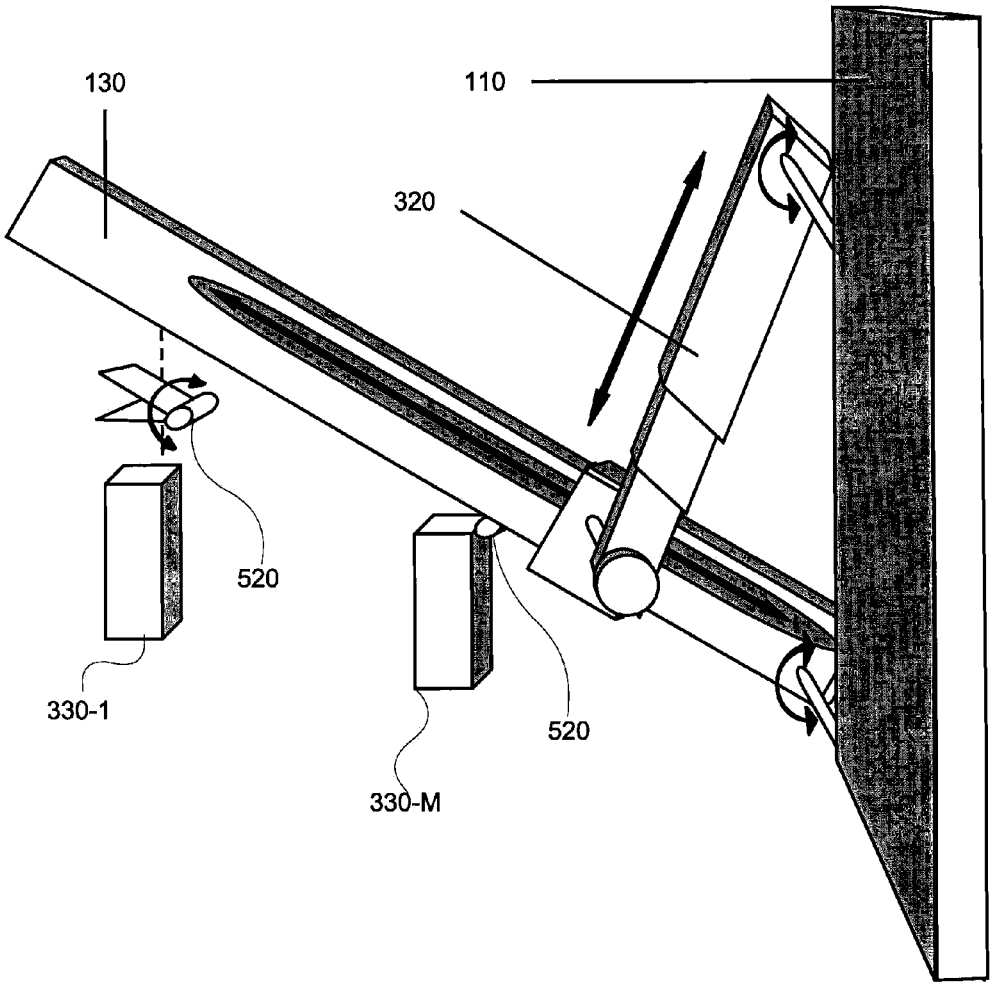
FIG. 5 is a side view illustrating an exemplary support leg for a convertible luggage bag system, according to principles described herein.

FIG. 2 is a perspective view of the frame (200) according to one exemplary embodiment. As illustrated, the exemplary frame (200) includes a telescoping handle (115) extending to a bottom brace (240), a plurality of transverse supports (220) extend tangentially from the telescoping handle (115) to the bottom brace (240), and a plurality of extended floor supports (130) rotatably coupled to the bottom brace (24) at one or more floor support joints (210). FIG. 2 illustrates an exemplary embodiment wherein the floor supports (130) are attached to the bottom brace of the frame (200) with a locking pivot structure (210). FIG. 5 illustrates another exemplary embodiment where the floor supports (120) are attached to the luggage base (110) via a joint (430), which may include, but is in no way limited, to rotary joints, rotary unions, multiple passage rotary union and slip-rings, bearing rotary union and any other joint, dowel, rotary, or any other mechanism or feature suitable to enable rotation of a floor support (130) around the luggage base (110), while maintaining the structural ret to attachment to a brace (320). In the exemplary embodiment illustrated in FIG. 2, the floor support (130) may include a groove which a pin base locking mechanism may be used to ether guide the brace (320) and/or lock the brace (320) in place with respect to the floor support (130). When the system (100) is being used as a luggage bag to transport clothing and other items, the floor supports (130) are oriented to run parallel with the telescoping handle (115) so as not to protrude from the bag (100), allowing the luggage bag system (100) to be portable. When the convertible luggage bag (100) has been converted to a standing rack, the floor supports (130) are oriented perpendicular to the coplanar luggage base (110), telescoping handle (115), and lids (120), to provide balance and to aid in keeping the system (100) stationary.

Figure 3:
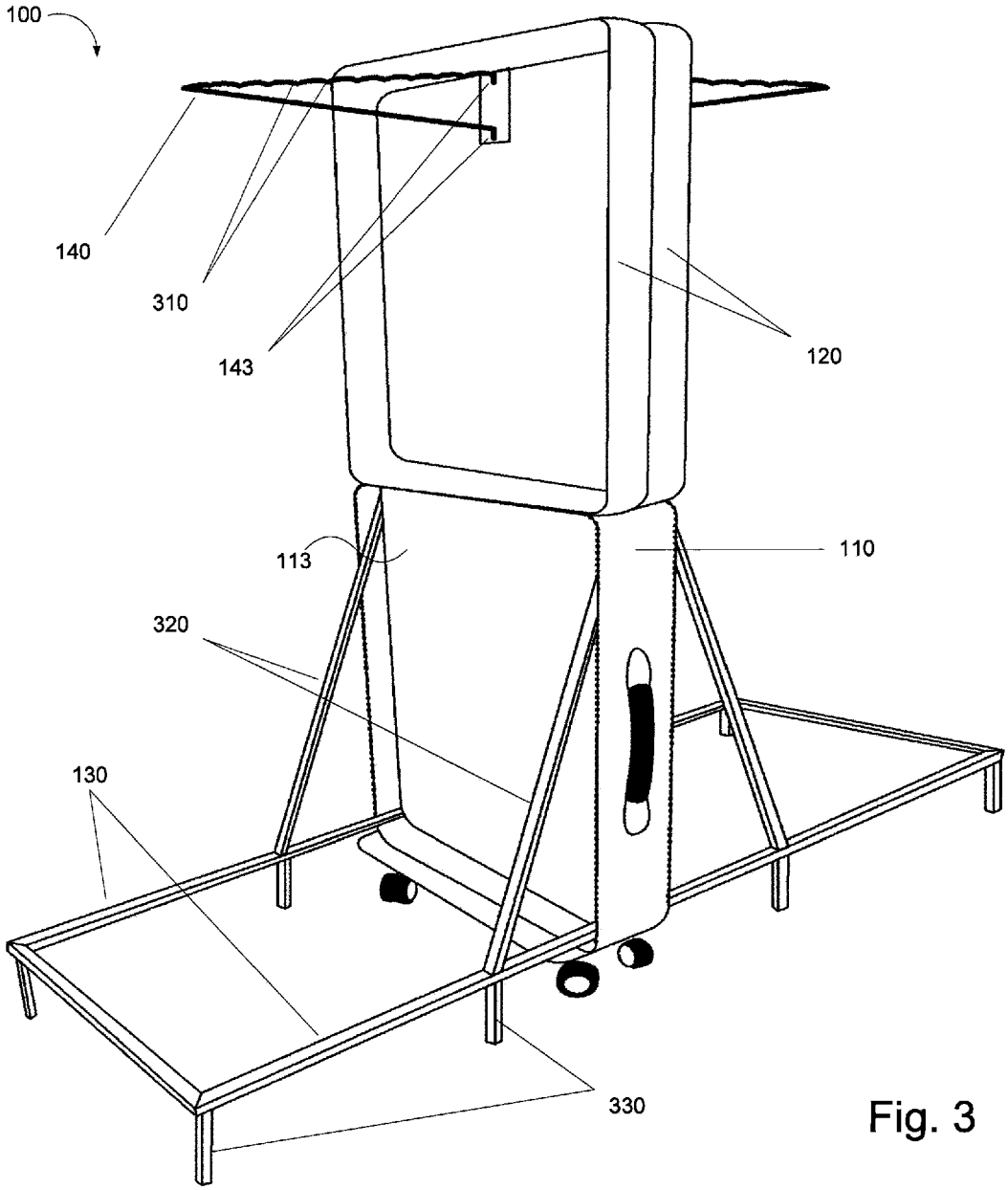
FIG. 3 is a perspective view illustrating an exemplary convertible luggage bag system in an opened position, according to principles described herein.

An alternative embodiment to FIG. 1 or 3, may include, but is not limited to floor supports (130) that rotate past ninety degrees till the ends opposite of the base (110) touch the ground.

In still other embodiments the ends of the floor supports (130) may include, but are in no way limited to, a material with a high coefficient of friction such that the base is not able to freely move around.

Figure 4:
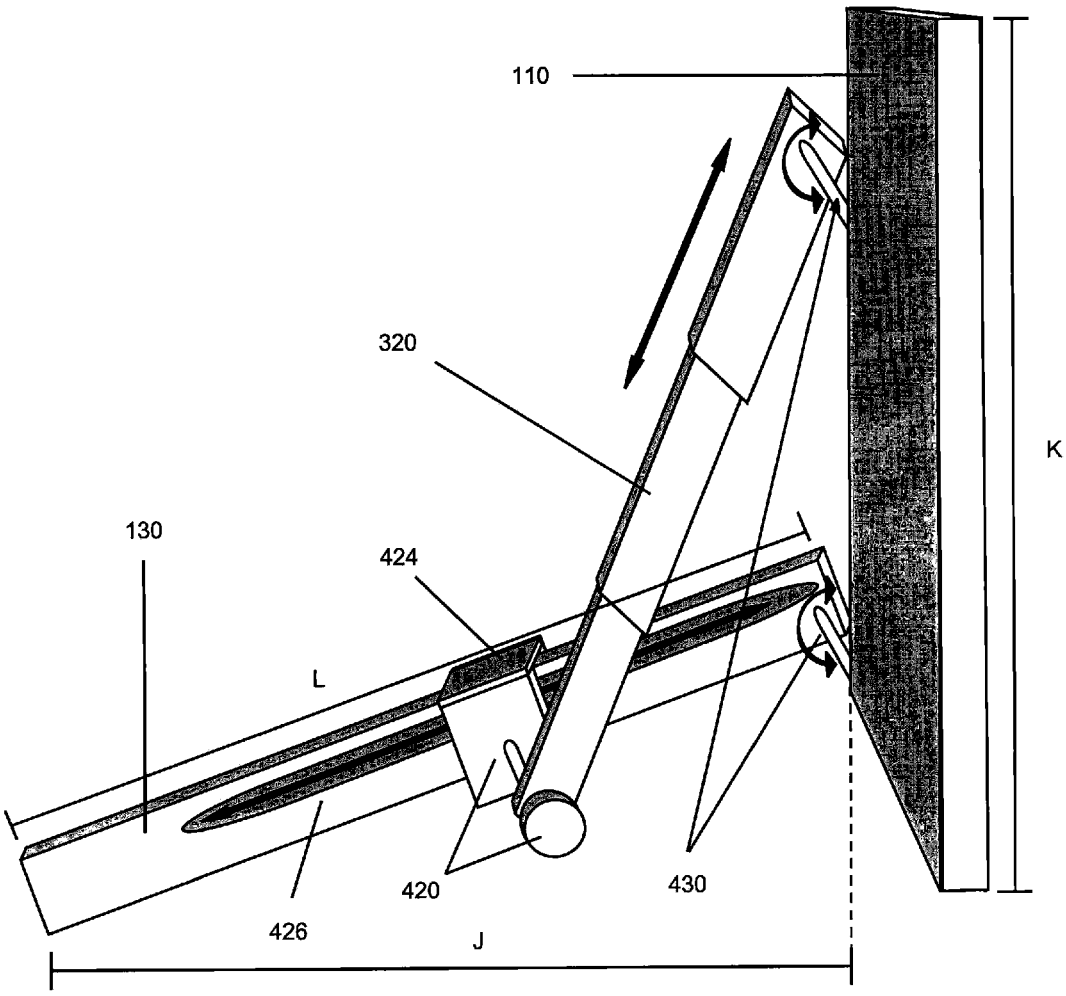
FIG. 4 is a side view illustrating an exemplary support leg for a convertible luggage bag system, according to principles described herein.

FIG. 4 further illustrates the projected length of the luggage base (110) (K), the floor supports (130) (L), the distance between the point on the projected ground plane where the floor supports (130) are attached to the base (110), and the point that the floor support touches the floor (J). Therefore in the exemplary view, K is greater than or equal to L, as L must be short enough to rotate at least ninety degrees and be completely encased in the luggage base (110). J must be shorter than L, as J is the base of a triangle where there is a ninety-degree angle between the floor and the luggage base (110), and the hypotenuse is L. In a right-triage such as the one described, the hypotenuse is always the longest member, therefore J must be shorter than L. Finally, in this exemplary view J would be the furthest distance from the base (130) positive parallel hanger bars (140) could extend.

In another exemplary system, the floor supports (130) may be one or more telescopic rods which may extend beyond the radius hanger bar (140) from the luggage base (110). If the hanger bar (140) attaches to the lid in a fixed position then only one telescoping rod may be used. Furthermore, the exemplary telescoping rods would also not be limited to the use of feet, instead the floor supports (130) would slope downward such that the end of each rod touches the ground. The ends of the rods may also have a surface or coating having a high coefficient of fiction to better stabilize the system (100), just as feet (330) would.

E. Collapsible Hanger Bars (140)

Returning again to FIG. 1, the collapsible hanger bars (140) are attached to the lids (120), such that they extend outward, substantially perpendicular to the lids (120), and generally positively parallel with the extended floor supports (130). As mentioned above, the hanger bars (140) do not typically extend beyond the projected length of the floor supports (130) in order to maximize stability of the deployed system (100).

In one exemplary embodiment illustrated in FIG. 1, the hanger bars (140) form a right angle with the lids (120). In other exemplary embodiments (e.g. FIG. 3), the hanger bar (120) may also include a supportive diagonal bar which is attached to the tip of the hangar bar (140) and the lids (120).

F. Collapsible Hanger Bar Connectors (143)

Furthermore, the hanger bar connectors (143) fasten the hanger bar (140) to the upright lid (120). According to one exemplary embodiment, the hanger bars (140) may be permanently attached, or may be removably attached after the lid (120) is fastened in an upright position. In an exemplary embodiment shown in FIG. 1, the hanger bar connectors (143) can be hinges or joints that allow the hanger bar (140) to pivot, such that the hanger bar (140) is perpendicular with the lids (120) when the system (100) is deployed as a rack and flush against the lids (120) otherwise. In an alternative exemplary embodiment the hanger bar connectors (143) may include a sleeve and pins extruding from the hanger bars (140) that slip into the sleeves when extended. The hanger bar connectors may also include, but are in no way limited to, rotary joints, rotary unions, multiple passage rotary union and slip-rings, bearing rotary union and any other joint, dowel, rotary, or any other mechanism or feature suitable to attach, fasten, collapse, or extend a hanger bar (140).

FIG. 2 illustrates a frame (200) for the converted luggage bag system (100) according to one exemplary embodiment. The frame (200) may include, but is in no way limited to, a telescoping handle (115), floor supports (130), transverse supports (220), locking pivoting structures, and any other feature or mechanism to support the weight and positions required to act as a luggage bag, and a standing hanger rack.

While an exemplary frame (200) is shown in FIG. 2, those skilled in the art will recognize that the exemplary components illustrated in FIG. 2 are not intended to be limiting. Indeed, those skilled in the art will recognize that other alternative hardware environments and implementations may be used. Each of the components of the frame (200) will now be described in additional detail.

G. Floor Support Joints (210)

In the exemplary embodiment illustrated in FIG. 2 the floor support joints (210) include, but are in no way limited to, locking pivot structures. The locking pivot structures lock the floor supports (130) in place and connect the extended floor supports (130) to the bottom brace (240). The floor support joints (210) may also have a release mechanism configured to allow the floor supports (130) to rotatably collapse into the base. The floor supports (130) may then be locked into place again to keep the floor supports (130) out of the way when the system (100) is being used as a luggage bag.

The floor support joints (210) may include, but are in no way limited to, double locking pivots, release locking pivots, pivot bracket wing pivot, external lock pivot, or any other pivot, joint, hinge, feature, or mechanism suitable for locking the floor supports (130) in place, and maintaining an angle between the luggage base (110), frame (200), and floor supports (130).

H. Diagonal Supports (220)

The diagonal supports (220) are attached to the frame (200) from the outer left and right edges of the luggage base (110) at the floor support joints (210) to the top of the luggage base (110), where the telescopic handle (115) sits when retracted.

FIG. 3 is another exemplary embodiment of a convertible luggage bag system (100) illustrating the system (100) in a standing rack position. This exemplary embodiment includes, but is in no way limited to, a luggage base (110), lids (120), floor supports (130), hanger bars (140), hanger bar grooves (310), braces (320), feet (330), and any other feature or mechanism suit for a luggage bag, standing rack, or the transformation between either position.

While an alternative exemplary system (100) is shown in FIG. 3, the exemplary components illustrated in FIG. 3 are not intended to be limiting. Indeed, other alternative hardware environments and implementations may be used. Each of the components of the system (100) not already discussed will now be described in additional detail.

I. Hanger Bar Grooves (310)

The hanger bars (140) may include grooves (310) along the top such that a hanger stays in place and prevents incidental crowding of the hanging items. The hanger bar grooves (310) may include, but are in no way limited to, notches, dips, divots, grooves, or any other feature, device, or mechanism suitable for prevention of accidental crowding of hanging garments.

FIGS. 4 and 5 illustrate an exemplary subsystem that may be substituted into the exemplary embodiment illustrated in FIG. 3, specifically the luggage base (110), floor supports (130), brace (320), and feet (330). According to this exemplary embodiment, one end of each of the braces (320) are attached to the luggage base (110), and the other end attaches to the floor supports (130), and may be telescopically extended. Furthermore, the floor supports (130) are connected at one end to the luggage base (110), the ground on the other, and is attached to the brace (320) via a locking device and/or guiding device. The locking device and/or guiding device may include, but is in no way limited to a cuff (424) and pins (426). The feet (330) are attached to the floor supports (130) at one end, and make contact with the floor on the other when the system (100) is deployed as a standing hanger rack. The feet (330) are otherwise tucked away with the floor supports (130) in the luggage base (110).

While an exemplary subsystem consisting of the afore mentioned components and features are shown in FIGS. 4 and 5, the exemplary components illustrated in the Figure are not intended to be limiting. Indeed, other alternative hardware environments and implementations may be used. Each of the components afore mentioned will now be described in additional detail.

J. Braces (320)

The braces (320) illustrated in FIGS. 4 and 5 function to support the floor supports (130), however as illustrated in FIG. 1, braces (320) are not necessarily required. In this exemplary system, however, the floor supports may provide leverage when weight is applied to the hanger bars (140), such that the force on the joints (210) may be too great. The inclusion of the braces (320) alleviate some of that force by distributing it along its shaft against pressure points along the floor supports (130) and the luggage base (110).

The braces (320) may include a telescopic pole that extends far enough to be attached to the luggage base (110) on one end, and floor supports (130) on the other when the floor supports (130) are extended. Braces (320) must also retract sufficiently to be attached to the luggage base (110) and the floor supports (130) when the floor supports (130) are retracted.

The braces (320) may use any feature or mechanism to attach to the luggage base (110), which may include, but is in no way limited to, rotary joints, rotary unions, multiple passage rotary union and slip-rings, bearing rotary union and any other joint, dowel, rotary, or any other feature or subsystem suitable to attach a brace (320) to the luggage base (110) and enable rotation about the base.

In some exemplary embodiments, the braces (320) may be attached to floor supports (130) using a cuff (424) and pin (420) system. The pin (420) may include, but is in no way limited to ball lock pins, tab lock pins, pivot point pins, or any other pin or fastening device to fasten the brace (320) to a specific point along the floor supports (130). In other exemplary embodiments the braces (320) may also be fastened without a cuff, and attached using alternative features including, but in no way limited to, ball lock pins, tab lock pins, pivot point pins, or any other pin, features, or mechanisms to fasten braces (320) to a specific point along a floor support (130).

In still further exemplary embodiments the telescoping arm may be self locking or employ some other locking mechanism within the telescopic brace (320) which locks the length of the brace (320), which would remove the need for a sliding cuff, or any other sliding locking/fastening feature, device, or mechanism. Furthermore, other exemplary embodiments may omit braces (320) completely.

K. Feet (330)

Figure 6:
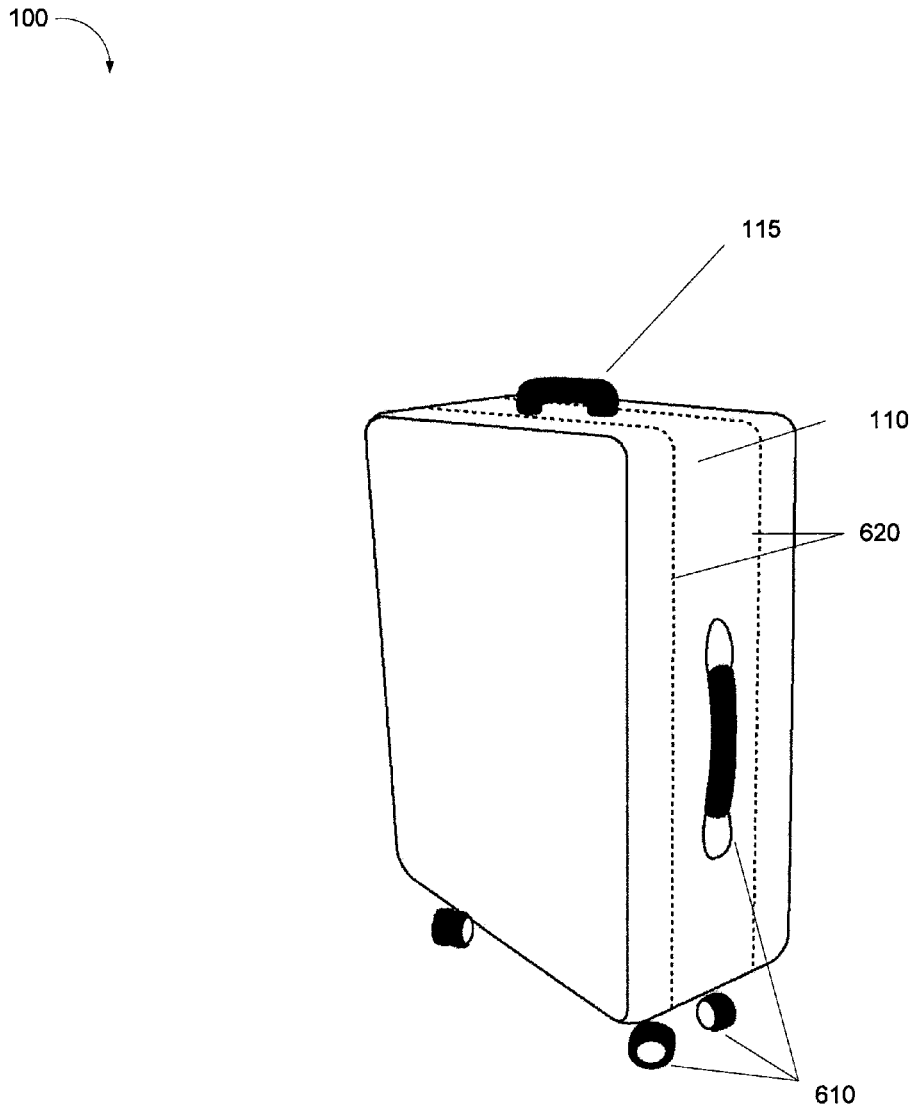
FIG. 6 is a perspective view illustrating an exemplary convertible luggage bag system in a closed position, according to principles described herein.
Figure 7:
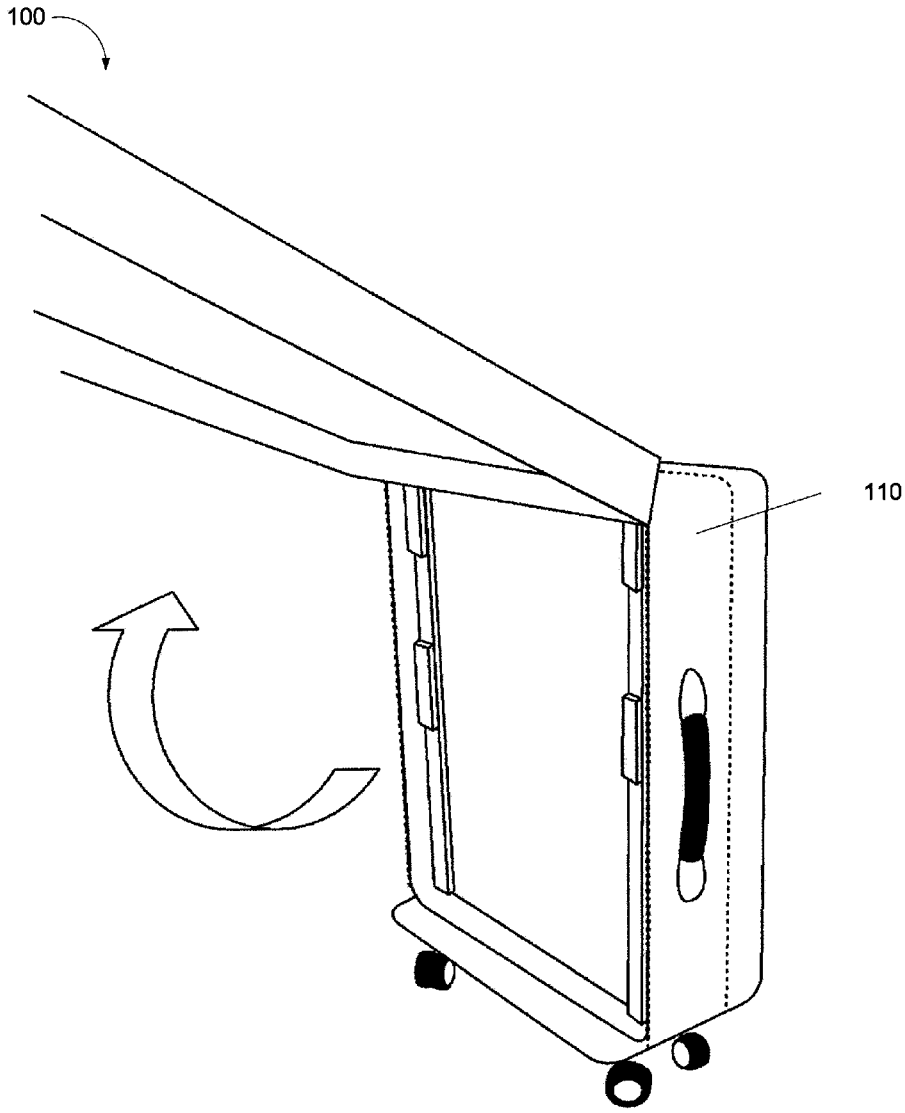
FIG. 7 is a perspective view illustrating the opening of an exemplary convertible luggage bag system, according to principles described herein.
Figure 8:
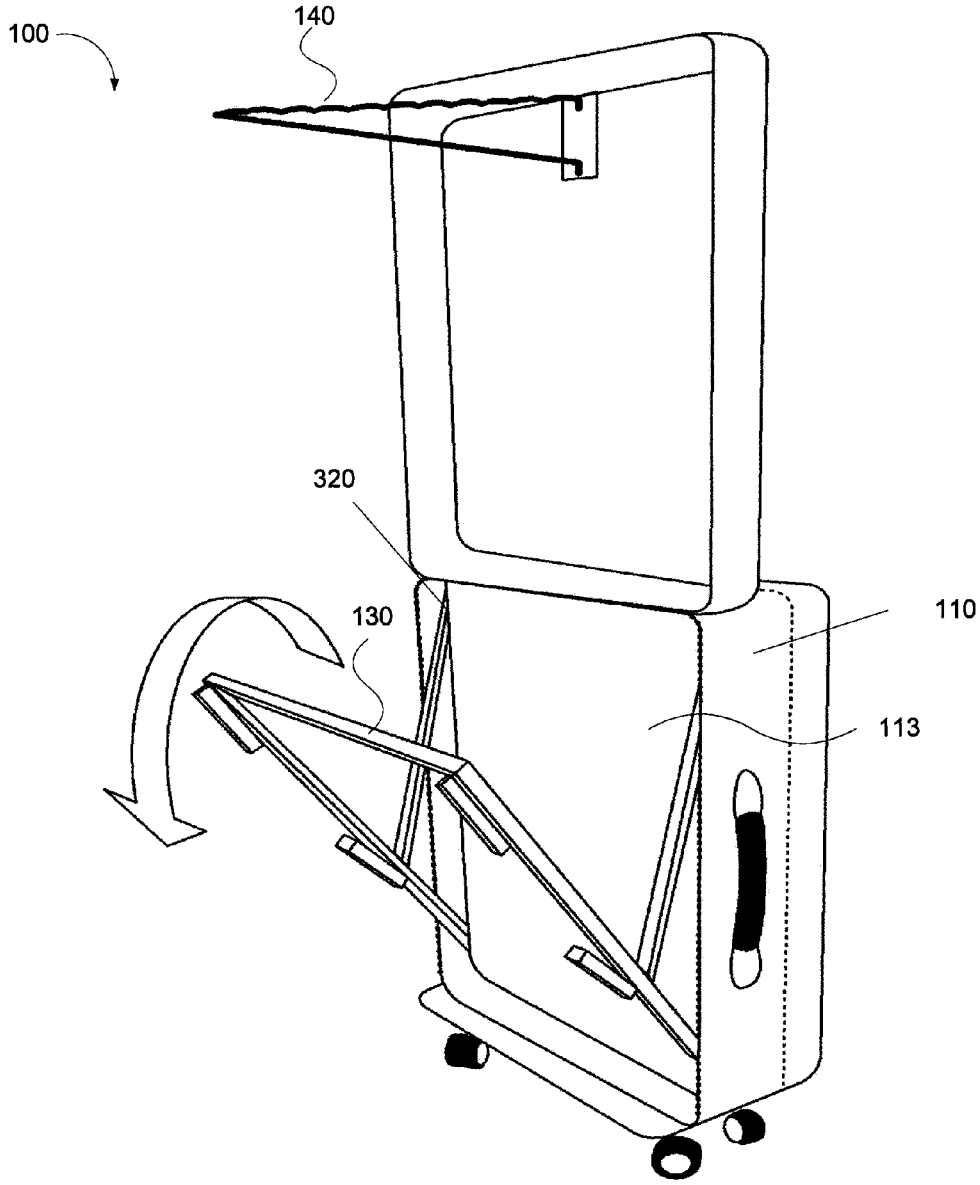
FIG. 8 is a perspective view illustrating an exemplary convertible luggage bag system partially opened, according to principles described herein.
Figure 9:
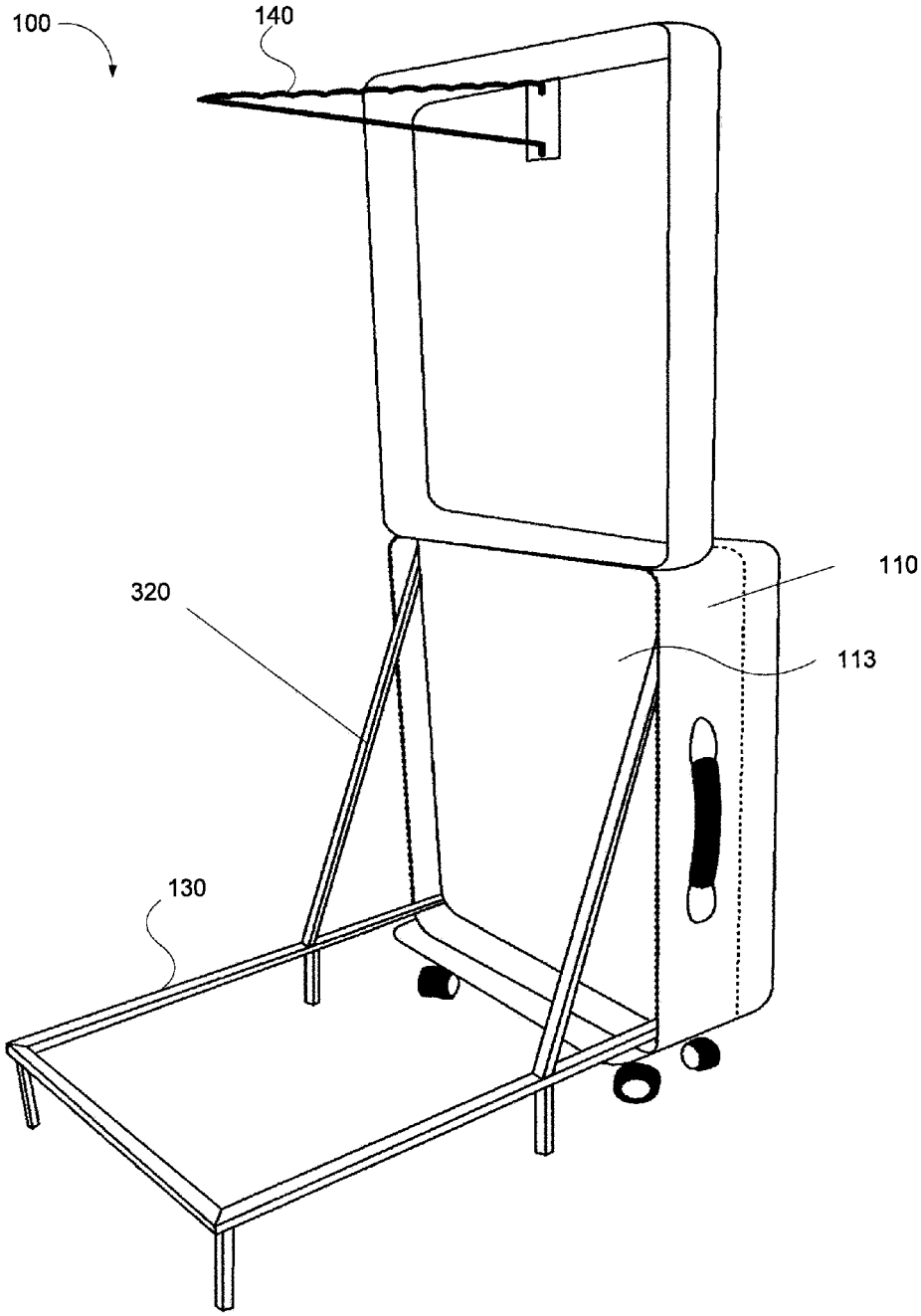
FIG. 9 is a perspective view illustrating an exemplary convertible luggage bag system partially opened, according to principles described herein.
Figure 10:
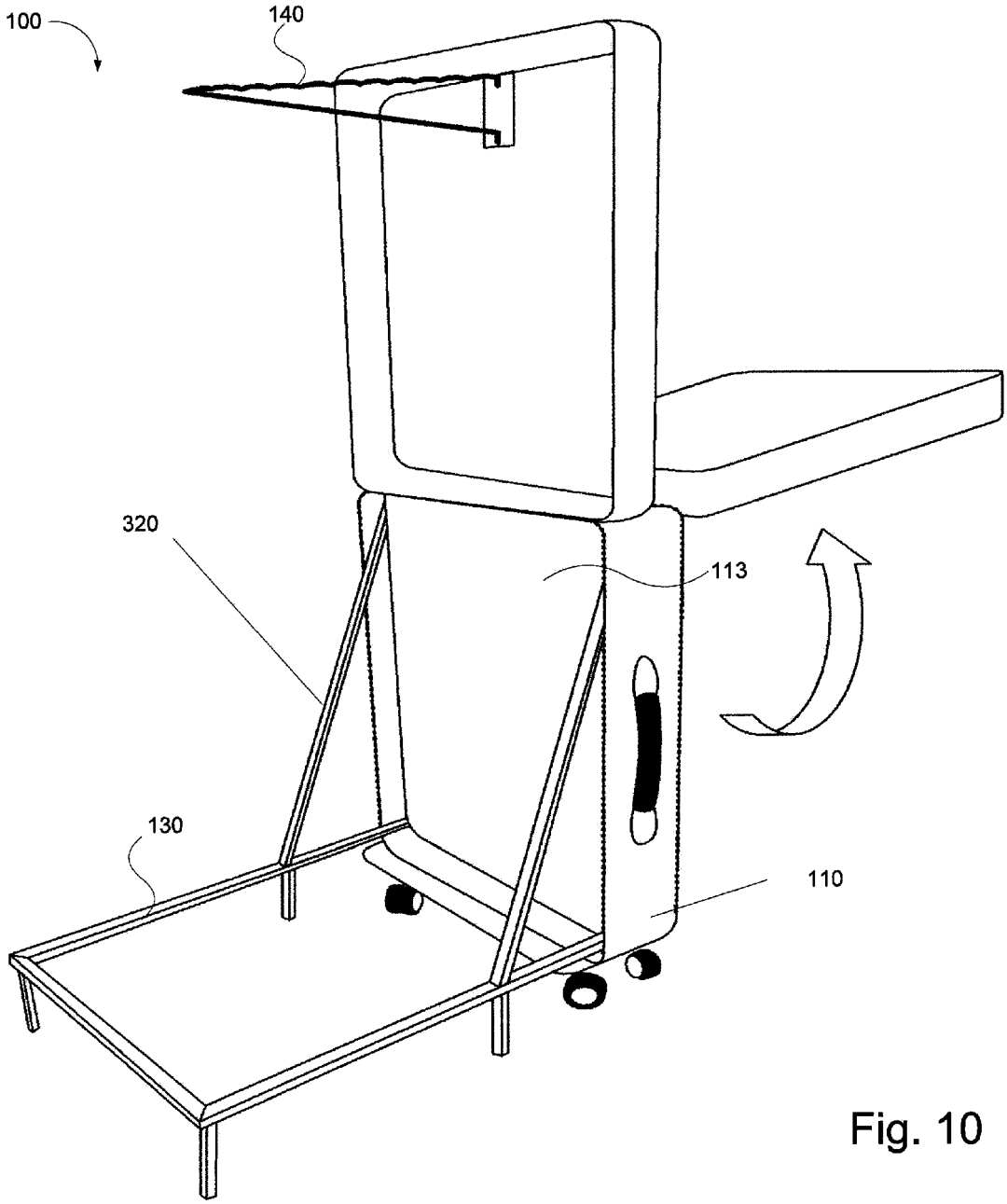
FIG. 10 is a perspective view illustrating an exemplary convertible luggage bag system partially opened, according to principles described herein.
Figure 11:
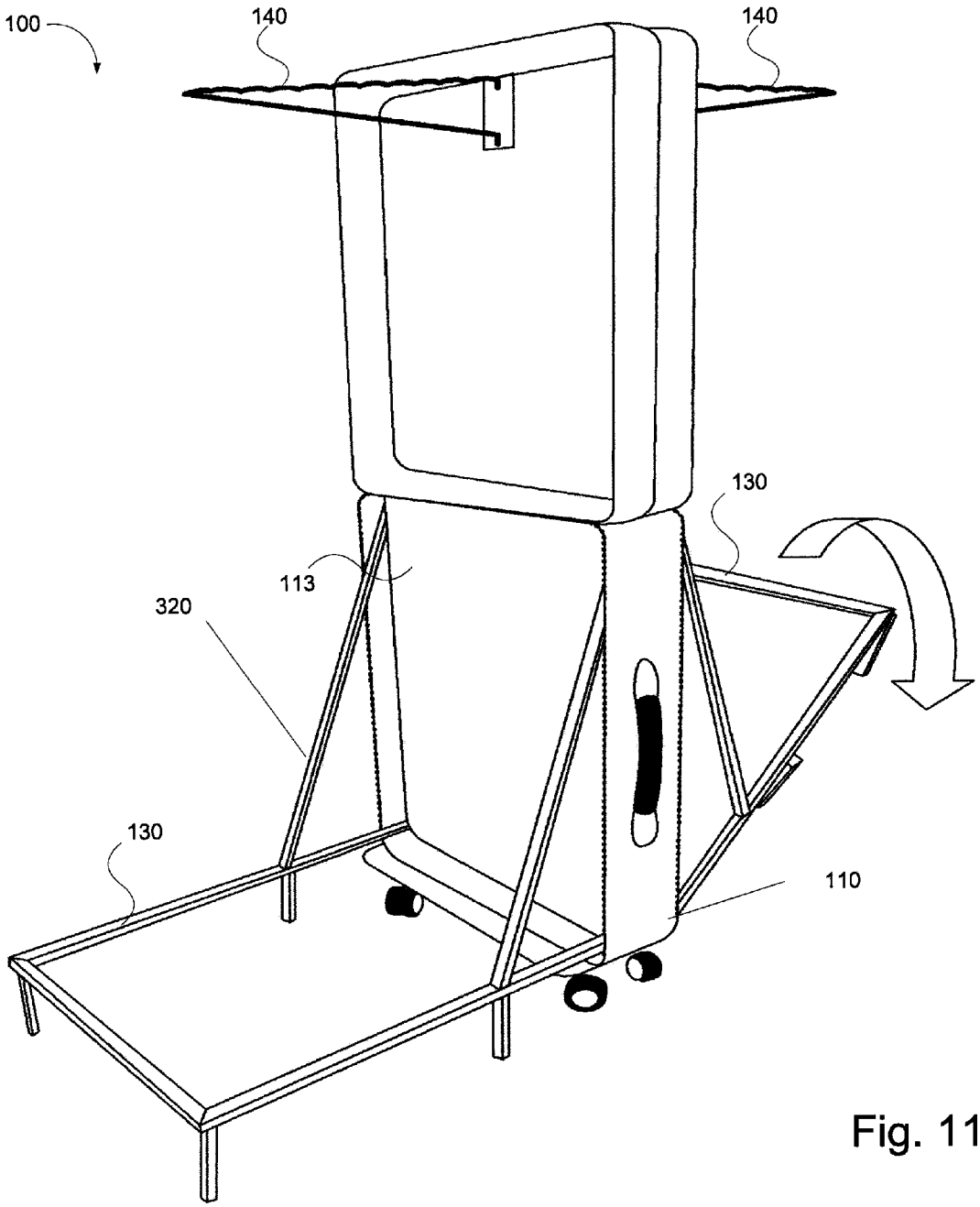
FIG. 11 is a perspective view illustrating an exemplary convertible luggage bag system partially opened, according to principles described herein.

The feet (330), in one exemplary embodiment illustrated in FIGS. 6-71, are connected, via a hinge (520), to the floor supports (130). The connection may include, but is in no way limited to, butt hinges, butterfly hinges, flush hinges, barrel hinges, concealed hinges, continuous hinges, or any other mechanism which may allow the feet (330) to be attached to the floor supports (130) and pivot about the floor supports (130) such that the feet are perpendicular to the floor supports (130) when the floor supports (130) are extended, and parallel or even flush against the floor supports (130) when the floor supports (130) are retracted.

In an alternative embodiment, the feet (330) may also be fixed to the floor supports (130) such that no rotation is ever made. Such an exemplary system may include a design such that when the floor supports (130) are retracted, the feet (330) rest against a wall of the luggage base (110) leaving as much internal volume as possible for luggage.

III. Exemplary Method and Operation

FIGS. 6 through 11 illustrate the exemplary system (100) in various stages of transformation according to one exemplary embodiment. Starting in FIG. 6, the system (100) is configured to be a luggage bag, with FIGS. 7-10 illustrating intermediate steps, ending with FIG. 11 where the system is configured in a standing rack configuration.

Figure 12:
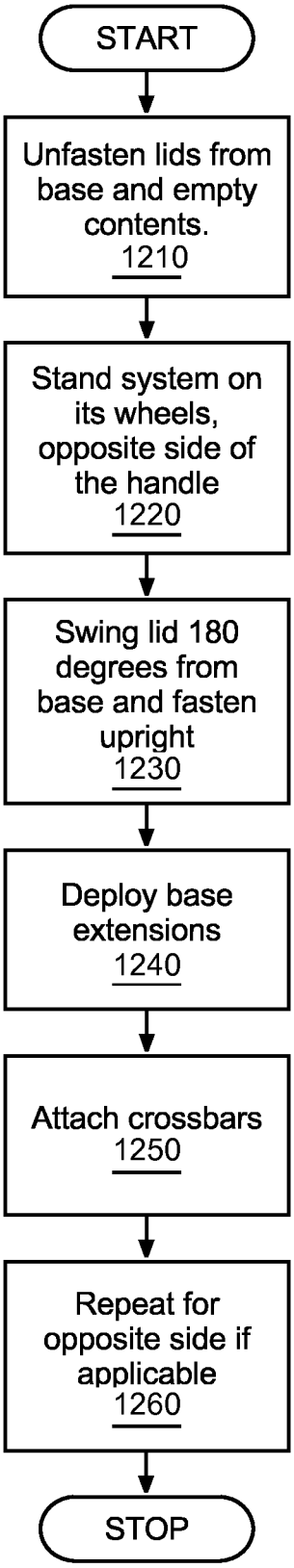
FIG. 12 is a flowchart illustrating an exemplary convertible luggage bag system transformation process, according to principles described herein.

FIG. 12 illustrates an exemplary process for deploying the system (100) from a luggage bag into a standing clothing rack. While FIG. 12 illustrates exemplary steps according to one exemplary embodiment, other embodiments may omit, add to, reorder, and/or modify any of the steps shown in FIG. 12.

As shown in FIG. 12, the lids (120) are unfastened from the luggage base (110) and the contents are set aside (step 1210). Since the bag is likely laying on its side during step 1210, next the bag must be positioned upright, such that the handle (115) is on the side opposite to the ground (step 1220).

Next the lids (120), which are already unfastened from the luggage base (110), rotate upward along the top edge of the luggage base (110) and fasten in an upright position, planar with the luggage base (110) (step 1230). The lids (120) may be fastened to the luggage base (110), handle (115), or each other (120).

The floor supports (130) are then extended (step 1240). Extending the floor supports (130), according to some exemplary embodiments, may also include unfolding or extending the feet (330) and/or the braces (320).

After the floor supports (130) are extended (step 1240), the hanger bars (140) may be extended (step 1250). While it is not requisite for the floor supports (130) to be extended first, doing so will make the system (100) stable and stationary. This order will make setup easier and eliminate the chance that items will be hung on the hanger bars (140) before the system is stable enough to support the extra weight on either side.

If the system (100) is two sided, meaning if there are lids (120) on both sides, with floor supports (130) and hanger bars (140), then the step taken to extend the first side may be repeated for the second side (step 1260).

Figure 13:
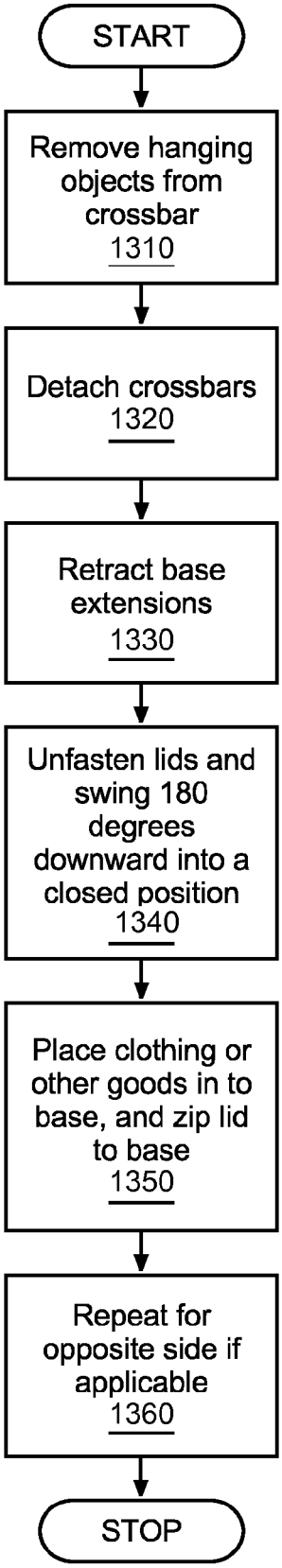
FIG. 13 is a flowchart illustrating an exemplary convertible luggage bag system transformation process, according to principles described herein.

FIG. 13 illustrates an exemplary process for restoring the system (100) from a standing clothing rack to a luggage bag. While FIG. 13 illustrates exemplary steps according to one embodiment, other embodiments may omit, add to, reorder, and/or modify any of the steps shown in FIG. 13.

As shown in FIG. 13, first any hanging object should be removed from the hanger bars (140) (step 1310). After all items have been removed, the hanger bars (140) may collapse or detach, such that the lids (120) will be able to close and storage space will be minimally impacted by the presence of the hanger bars (140) (step 1320). These previously hanging objects may be set aside to be stored in the luggage bag.

Next, the system is stable enough to retract the floor supports (130) (step 1330). In some exemplary embodiments, retraction of the floor supports (120) may include, but is in no way limited to collapsing the feet (140) attached to the floor supports (130), and retraction of telescopic brace (320). The cuff (424) and pin (420) system locking the telescopic brace (320) and the floor supports (130) should be unlocked, as well as any self-locking mechanism implemented into, or connected to, the brace (320) should also be released.

The lids (120) may then be unfastened from the luggage base (110), handle (155), or each other (120), such that the lids (120) may swing 180 degrees downward about the top of the luggage base (110) into a closed position (step 1340). The luggage base (110) may be positioned such that items may be placed in the luggage base (110). After the luggage base (110) is filled, the lids (120) may be fastened to the luggage base (110) in the closed position (step 1350).

In some exemplary embodiments, if there are other lids (120) on other sides which are not fastened to the luggage base (110) in closed position, step 1350 may be repeated until the system (100) is converted back into a luggage bag (step 1360).

The preceding description has been presented only to illustrate and describe embodiments of the principles described herein. It is not intended to be exhaustive or to limit the disclosure to any precise form disclosed. The principles described herein may be practiced otherwise than is specifically explained and illustrated without departing from their spirit or scope. For example, the principles described herein may be implemented in a wide variety of applications, including, but not limited to, travelers, dancers, pageant contestants, and other persons that travel frequently with uniforms or outfits. It is intended that the scope of the invention be defined by the following claims.

What is claimed is:

1. A system comprising:

a rectangular base having a top side and a bottom side;

at least one lid pivotably coupled to said top side of said rectangular base to define an interior portion of said base, said at least one lid having a height;

a structural support frame coupled to said interior portion of said rectangular base; and a collapsible hanger bar coupled to said at least one lid, said collapsible hanger bar having a length;

wherein said frame further includes:

a brace member;

a telescopic handle coupled to said brace member, wherein said telescopic handle is configured to extend from said top side of said rectangular base a distance at least equal to said height of said at least one lid;

at least one floor support rotatably coupled to said frame within said interior portion of said base when in a retracted position; and a locking pivot structure configured to lock said at least one floor support in place.

2. The system of claim 1, wherein said at least one floor support rotatably coupled to said frame further comprises:

a first floor support rotatably coupled to said frame; and a second floor support rotatably coupled to said frame;

wherein said first floor support and said second floor support are each coupled to said frame by at least one locking pivot structure.

3. The system of claim 2, wherein said first floor support and said second floor support are each configured to be locked in a first and a second position;

wherein each of said first floor support and said second floor support are locked substantially parallel to said telescopic handle within said interior portion of said rectangular base in said first position; and wherein each of said first floor support and said second floor support are locked in a substantially perpendicular orientation relative to said telescopic handle when in said second position.

4. The system of claim 1, further comprising a plurality of transverse support members coupled to said telescopic handle and said brace member.

5. The system of claim 1, wherein said at least one lid is configured to rotate at least 180 degrees relative to said rectangular base; and wherein said at least one lid is configured to be fixedly coupled around said telescopic handle.

6. The system of claim 5, wherein said at least one lid further comprises a first lid and a second lid, wherein said first lid and said second lid are each pivotably coupled to said top side of said rectangular base on opposite sides of said rectangular base.

7. The system of claim 6, wherein said first lid and said second lid each comprise a mating member configured to couple said first lid to said second lid.

8. The system of claim 1, wherein said collapsible hanger bar further comprises:

a projection member rotatably fastened to said at least one lid; and a plurality of ridges defined on said projection member.

9. The system of claim 8, wherein said length of said collapsible hanger bar is less than a length of said at least one floor support.

10. A system comprising:

a base having a top side and a bottom side;

at least one lid pivotably coupled to said top side of said base to define an internal volume of said base, said at least one lid having a height;

a structural support frame coupled to an interior portion of said base; and a collapsible hanger bar coupled to said at least one lid, said collapsible hanger bar having a length;

wherein said frame further includes:

a brace member;

a telescopic handle coupled to said brace member, wherein said telescopic handle is configured to extend from said top side of said base;

at least one floor support rotatably coupled to said frame within said internal volume of said base when in a retracted position; and a locking pivot structure configured to lock said at least one floor support in place.

11. The system of claim 10, wherein said at least one floor support rotatably coupled to said frame further comprises:

a first floor support rotatably coupled to said frame within said internal volume of said base when in a retracted position; and a second floor support rotatably coupled to said frame within said internal volume of said base when in a retracted position;

wherein said first floor support and said second floor support are each coupled to said frame by at least one locking pivot structure.

12. The system of claim 11, wherein said first floor support and said second floor support are each configured to be locked in a first and a second position;

wherein each of said first floor support and said second floor support are locked substantially parallel to said telescopic handle within said internal volume of said base in said first position; and wherein each of said first floor support and said second floor support are locked in a substantially perpendicular orientation relative to said telescopic handle when in said second position.

13. The system of claim 10, further comprising a plurality of transverse support members coupled to said telescopic handle and said brace member.

14. The system of claim 10, wherein said at least one lid is configured to rotate at least 180 degrees relative to said base; and wherein said at least one lid is configured to be fixedly coupled around said telescopic handle.

15. The system of claim 14, wherein said at least one lid further comprises a first lid and a second lid, wherein said first lid and said second lid are each pivotably coupled to said top side of said base on opposite sides of said base.

16. The system of claim 15, wherein said first lid and said second lid each comprise a mating member configured to couple said first lid to said second lid.

17. The system of claim 10, wherein said collapsible hanger bar further comprises:

a projection member rotatably fastened to said at least one lid; and a plurality of ridges defined on said projection member.

18. A luggage system, comprising:

a rectangular base having a top side and a bottom side;

at least one lid pivotably coupled to said top side of said rectangular base to define an internal volume of said base, said at least one lid having a height;

a structural support frame coupled to an interior portion of said rectangular base; and a collapsible hanger bar coupled to said at least one lid, said collapsible hanger bar having a length;

wherein said frame further includes:

a brace member;

a telescopic handle coupled to said brace member, wherein said telescopic handle is configured to extend from said top side of said rectangular base a distance at least equal to said height of said at least one lid;

at least one floor support rotatably coupled to said frame within said internal volume of said base when in a retracted position; and a locking pivot structure configured to lock said at least one floor support in place;

wherein said at least one floor support rotatably coupled to said frame further comprises:

a first floor support rotatably coupled to said frame within said internal volume of said base when in a retracted position; and a second floor support rotatably coupled to said frame within said internal volume of said base when in a retracted position;

wherein said first floor support and said second floor support are each coupled to said frame by at least one locking pivot structure.

19. The system of claim 18, wherein said first floor support and said second floor support are each configured to be locked in a first and a second position;

wherein each of said first floor support and said second floor support are locked substantially parallel to said telescopic handle within said internal volume of said rectangular base in said first position; and wherein each of said first floor support and said second floor support are locked in a substantially perpendicular orientation relative to said telescopic handle when in said second position.

20. The system of claim 19, wherein said at least one lid further comprises a first lid and a second lid, each configured to rotate at least 180 degrees relative to said rectangular base, wherein said first lid and said second lid are each pivotably coupled to said top side of said rectangular base on opposite sides of said rectangular base.

* * * * *